US011801542B2

(12) United States Patent
Yang et al.

(10) Patent No.: US 11,801,542 B2
(45) Date of Patent: Oct. 31, 2023

(54) MICRO CONTROL DEVICE FOR SIMULATING ELECTRIC THERMAL FIELD CHANGE OF PLATE/STRIP

(71) Applicant: Yanshan University, Qinhuangdao (CN)

(72) Inventors: Lipo Yang, Qinhuangdao (CN); Gengliang Liu, Qinhuangdao (CN); Hailong Zhang, Qinhuangdao (CN); Jiaxuan Yang, Qinhuangdao (CN); Lei Pan, Qinhuangdao (CN); Yunpeng Liu, Qinhuangdao (CN)

(73) Assignee: YANSHAN UNIVERSITY, Qinhuangdao (CN)

( * ) Notice: Subject to any disclaimer, the term of this patent is extended or adjusted under 35 U.S.C. 154(b) by 486 days.

(21) Appl. No.: 17/209,320

(22) Filed: Mar. 23, 2021

(65) Prior Publication Data

US 2021/0299722 A1 Sep. 30, 2021

(30) Foreign Application Priority Data

Mar. 24, 2020 (CN) ..... 202010214899.2

(51) Int. Cl.
*C21D 1/04* (2006.01)
*B21B 3/00* (2006.01)
(Continued)

(52) U.S. Cl.
CPC ..... *B21B 37/74* (2013.01); *C21D 1/40* (2013.01); *C21D 9/52* (2013.01); *C21D 11/00* (2013.01);
(Continued)

(58) Field of Classification Search
CPC .. C21D 1/04; C21D 11/00; B21B 3/00; B21B 3/02; B21B 9/00; B21B 37/74; B21B 2261/21; B21B 2263/02; B21B 37/00
See application file for complete search history.

(56) References Cited

FOREIGN PATENT DOCUMENTS

CN 109351773 A * 2/2019 ..... B21B 1/22
CN 109433823 A * 3/2019 ..... B21B 1/38

OTHER PUBLICATIONS

Translation of CN-109351773 (Year: 2019).*
Translation of CN-109433823 (Year: 2019).*

* cited by examiner

*Primary Examiner* — Adam J Eiseman
*Assistant Examiner* — Bobby Yeonjin Kim
(74) *Attorney, Agent, or Firm* — IPRO, PLLC

(57) ABSTRACT

The disclosure provides a micro control device for simulating the electric thermal field change of a plate/strip, comprising a plate shape simulating test platform, a high current regulating power supply, a current regulating device, a thermal imager, a thermocouple, a non-contact type full field strain gauge, a high-power current control device and an electro-plastic control system; for a plate/strip with large width to thickness ratio and high hardness and brittleness alloy, different numbers of electrodes are arranged laterally along the movable supporting beam. A high-power current control device is used to realize the sub-regional control of the electric field, thermal field and stress field of the plate/strip; at the same time, the movable supporting beam and tension sensor are used to test the working conditions of the plate/strips with different lengths and widths, to simulate the instantaneous synchronous entanglement process between different fields. An electro-plastic control system is used to realize the intelligent closed-loop control of specific working conditions. The device provides a high-precision physi-
(Continued)

cal test platform for studying the non-uniform electro-plastic effect of a high width to thickness ratio and high hardness brittle strip during an actual rolling process, and adds a new and high-efficiency adjustment method to the traditional rolling mill system.

8 Claims, 6 Drawing Sheets

(51) Int. Cl.

| | |
|---|---|
| ***B21B 9/00*** | (2006.01) |
| ***B21B 37/74*** | (2006.01) |
| ***C21D 1/40*** | (2006.01) |
| ***C21D 9/52*** | (2006.01) |
| ***C21D 11/00*** | (2006.01) |

(52) U.S. Cl.
CPC ..... *B21B 2261/21* (2013.01); *B21B 2263/02* (2013.01)

MICRO CONTROL DEVICE FOR SIMULATING ELECTRIC THERMAL FIELD CHANGE OF PLATE/STRIP

TECHNICAL FIELD

The present disclosure relates to the field of electro-plastic rolling of a special alloy plate/strip, in particular to a micro control device for simulating electric thermal field change of a plate/strip.

BACKGROUND

Although rolling is a very high-efficient processing method, it is difficult for traditional rolling process to be directly applied to a high hard brittle alloy material. In recent years, with respect to a difficult-to-deform material, a series of theoretical and technical researches have been carried out at home and abroad for solving the rolling and forming problem of an electro-plastic plate, such as high strength steel, stainless steel, titanium alloy, zirconium alloy and magnesium alloy etc., Two aspects are focused on: an electro-plastic effect mechanism and a current-assisted formation. An electro-plastic thermal effect and a pure electro-induced effect are mainly adopted. Flow stress is reduced by adjusting the evolution characteristics of the metallic tissue and the macroscopic force energy parameters, so as to improve the processing difficulty and poor plasticity of difficult-to-deform strips, such as brittleness or high hardness. In addition, some engineering problems, such as edge crack, microcrack or micro hole, are expected to be solved.

However, in the field of rolling, an experimental object of a current-assisted formation is still remained in a wire rod and/or a narrow strip, and its application is still not mature enough. The lack of high-efficiency electro-plastic measurement and control devices and their corresponding current control methods have largely restricted the process of industrialization of electro-plastic theory and technology. Especially for a wide strip high-speed electro-plastic rolling process, it is self-evident that it is difficult to achieve a stable rolling. Therefore, research and development of a high-efficiency electro-plastic rolling device and its matching current control means is of vital importance for the difficult-to-deform extremely thin strip to improve the control ability of electro-plastic effect. An invention patent with publication number CN109351773A and disclosure title "an electro-plastic wide strip rolling device" provides a wide strip electro-plastic rolling device, which uses a conductive block embedded inside a conductive roll and a work roll to provide a current distribution online adjusting means, so as to improve the uniformity of a lateral current distribution of an electro-plastic rolling wide strip. However, a high-speed electro-plastic rolling process is extremely unstable, which makes a sensor unable to accurately obtain the law of the distribution parameters on a current field and a thermal field.

SUMMARY

The purpose of the disclosure is to provide a device which can finely adjust a distribution regulation and a multi-field entanglement process of electric, thermal and force field in a high direction and/or a lateral direction of a plate/strip, so as to change a local constitutive relationship or a flow strain state of a rolled piece during a rolling process. By fully using an electro-plastic effect and exploring a plasticizing effect of a high hardness and brittle plate/strip during a rolling process, a physical simulation device and a multi working condition test platform are provided for a true electro-plastic rolling of a hard brittle alloy plate/strip with a large width to thickness ratio.

In order to solve the above technical problem, the disclosure provides a micro control device for simulating electric thermal field change of a plate/strip, wherein the micro control device comprises a plate shape simulating test platform, a high current regulating power supply, a current regulating device, a thermal imager, a thermocouple, a non-contact type full field strain gauge, a high-power current control device and an electro-plastic control system;

The plate shape simulating test platform comprises a test platform steel plate, a movable supporting beam, a plate/strip specimen, a conductive clamp, a slipknot screw, a tension sensor and a servo electric cylinder;

The test platform steel plate is used to provide support for the movable supporting beam, the plate/strip specimen, the conductive clamp, the slipknot screw, the tension sensor and the servo electric cylinder; the movable supporting beam is fixedly connected to two ends of the test platform steel plate, which is a force bearing device; the movable supporting beam is fixed on the test platform steel plate according to size specification of a specimen, and is drilled along a lateral direction; a longitudinal distance of the movable supporting beam is stepless or multistage adjustable; a first end of the conductive clamp is clamped at a lateral punching position of the plate/strip specimen, a first end of the tension sensor is connected to a second end of the conductive clamp through the slipknot screw, and a second end of the tension sensor is connected to the servo electric cylinder; the servo electric cylinder and the tension sensor can be adjusted or measured separately to change lateral local field distribution of the plate/strip;

The high current regulating power supply provides a current for the plate/strip specimen, and the current is a DC pulse;

The current regulating device comprises a plurality of high-power current control devices which is installed between the high current regulating power supply and the conductive clamp to realize the respective regulation of current flowing through the two ends of the specimen; and the parameters of the current are synchronously transmitted to the electro-plastic control system;

The high-power current control device comprises a servo motor, an insulating push rod, a conductive clamp connecting end, a high current copper pole slider, a copper wire, an insulating bracket and a power supply connecting end; the copper wire is wound on the insulating bracket and surface of which is insulated; the power supply connecting end is connected to a positive electrode of the high current regulating power supply, and the conductive clamp connecting end is connected to the conductive clamp; and the servo motor controlled by the electro-plastic control system drives the high current copper pole slider to change length of the copper wire connected to a circuit to change resistance and gradually change current in the circuit;

The electro-plastic control system sets off-line and fine-tunes the electrical pulse parameters and the currents of each path according to the initial temperature and tension distribution conditions of the plate/strip, and obtains temperature and tension distribution conditions close to the control target;

The thermal imager is arranged above the test platform for measuring a thermal field of the tested plate/strip, meanwhile the thermal imager is calibrated by a thermocouple embedded on a surface of the plate/strip specimen;

The non-contact type full field strain gauge is arranged above the test platform steel plate with a lens direction of which is perpendicular to an upper surface of the plate/strip specimen, for carrying out a full field strain measurement of the plate/strip specimen;

Data of current field, thermal field and stress field obtained in real time by the thermal imager, the non-contact type full field strain gauge and the tension sensor are transmitted to the electro-plastic control system.

In the above technical scheme, the electro-plastic control system can use a high-current adjustment power supply and a high-power current control device according to the actual tension distribution, and independently change the electrical parameters of each path in real time, thereby adjust the local field characteristics of the plate/strip, so as to obtain the tension distribution law that meets the requirements. At the same time, according to actually measured value of a thermal field and a tension field, combined with a thermal imager or a thermocouple, the electro-plastic control system simulates synchronous entanglement process of each field so as to realize the fine matching and closed-loop controlling of electricity, thermal and force, as well as to reuse electro-plastic effect.

Preferably, a distance between two paths of the conductive clamp along the plate/strip specimen is 26 mm.

Preferably, the thermocouple is embedded in the middle and/or the edge of the plate/strip specimen in sequence.

Preferably, the servo electric cylinder and the tension sensor can be adjusted or measured separately to change the lateral local field distribution of the plate/strip specimen.

Preferably, a Hall current sensor is installed on a wire connecting the high-power current control device and the conductive clamp, for collecting in real time and feeding each path current back to the electro-plastic control system to form a closed loop so as to obtain a target current field, a target thermal field and a target stress field.

Preferably, the current regulating device comprising a positive current regulating device and a negative current regulating device; the positive current regulating device is connected between a positive electrode of the high current regulating power supply and the conductive clamp; the negative current regulating device is connected between a negative electrode of the high current regulating power supply and the conductive clamp.

Preferably, the movable supporting beam is bolted at two ends of the test platform steel plate through a rib plate.

Preferably, a current provided by the high current regulating power supply is DC pulse, and peak current, pulse width and frequency of the DC pulse can be adjusted online.

Preferably, the synchronous current parameters transmitted to the electro-plastic control system comprises the high current regulating power supply parameters and a conductive sequence; the conductive sequence is a current value of the pulse current passing through each path, and the high current regulating power supply parameters include effective current, frequency and pulse width.

Compared with prior art, the disclosure has following beneficial effects:

The disclosure provides a micro control device for simulating an electric thermal field change of a plate/strip, wherein a plate shape simulating test platform and the electro-plastic control system is used to simulate a real electro-plastic rolling current control process of a plate/strip. A sensor and a signal collecting device are used to measure in real time a strain changing regulation under different current fields and thermal fields, so as to synchronously observe a transient entanglement process of the three fields. On this basis, a number of conductive clamps are arranged laterally along a plate/strip specimen, and a high current regulating power supply and high-power current control device are used, to simulate an actual tension distribution, independently change the electrical parameters of each path in real time, on-line accurately simulate the entanglement effect of the current loading and supply strategy on the multi-physical field, apply currents of different amplitudes to the different regions of the strip, and adjust the local field characteristics of the strip. At the same time, the thermal field changes in response, to change the lateral distribution of the tension of the plate/strip, and then accurately control the electric field, the thermal field and the force fields during the process of the high-efficiency electro-plastic rolling of the ultra-thin strip with large width to thickness ratio and high hardness and brittleness, so as to obtain the distribution law of the tension required for the rolling process, thereby to meet a plasticization requirement of the rolling process of an ultra-thin strip with large width to thickness ratio and high hardness and brittleness.

MAIN REFERENCE NUMBERS

1—test platform steel plate,
2—movable supporting beam,
3—rib plate,
4—positive current regulating device,
5—high current regulating power supply,
6—thermal imager,
7—non-contact type full field strain gauge,
8—negative current regulating device,
9—plate/strip specimen,
10—conductive clamp,
11—slipknot screw,
12—tension sensor,
13—servo electric cylinder,
14—high-power current control device,
15—servo motor,
16—insulating push rod,
17—conductive clamp connecting end,
18—high current copper pole slider,
19—copper wire,
20—insulating bracket,
21—power supply connecting end.

DETAILED DESCRIPTION

Embodiments of the disclosure are described below with reference to the attached drawings.

Figure 1:
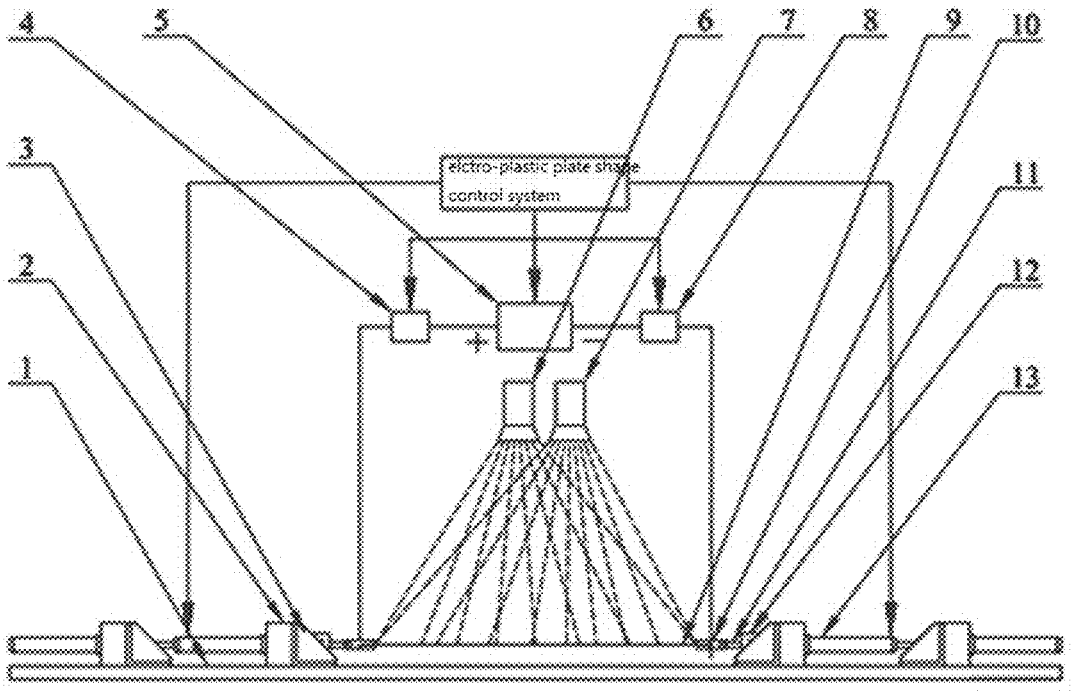
FIG. 1 is a schematic diagram of a micro control device for simulating electric thermal field change of a plate/strip in an embodiment of the disclosure.
Figure 2:
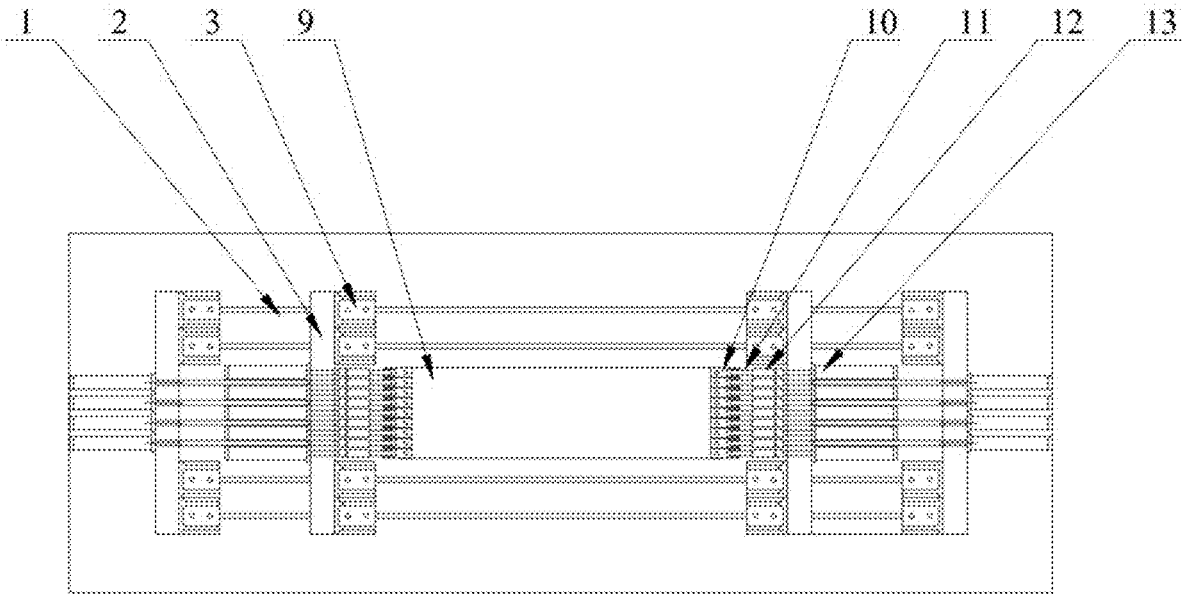
FIG. 2 is a schematic diagram of a plate shape simulating test platform in an embodiment of the disclosure.

As shown in FIG. 1 and FIG. 2, a micro control device for simulating a change of electric field of a plate/strip is provided in an embodiment of the disclosure, comprises a high current regulating power supply 5, a plate shape simulating test platform, a positive current regulating device 4 and a negative current regulating device 8, a thermal imager 6, a thermocouple, a non-contact type full field strain gauge and an electro-plastic control system. The test material is AZ31 magnesium alloy strip, and size specification of a specimen is 150 mm*130 mm*2 mm.

Figure 3:
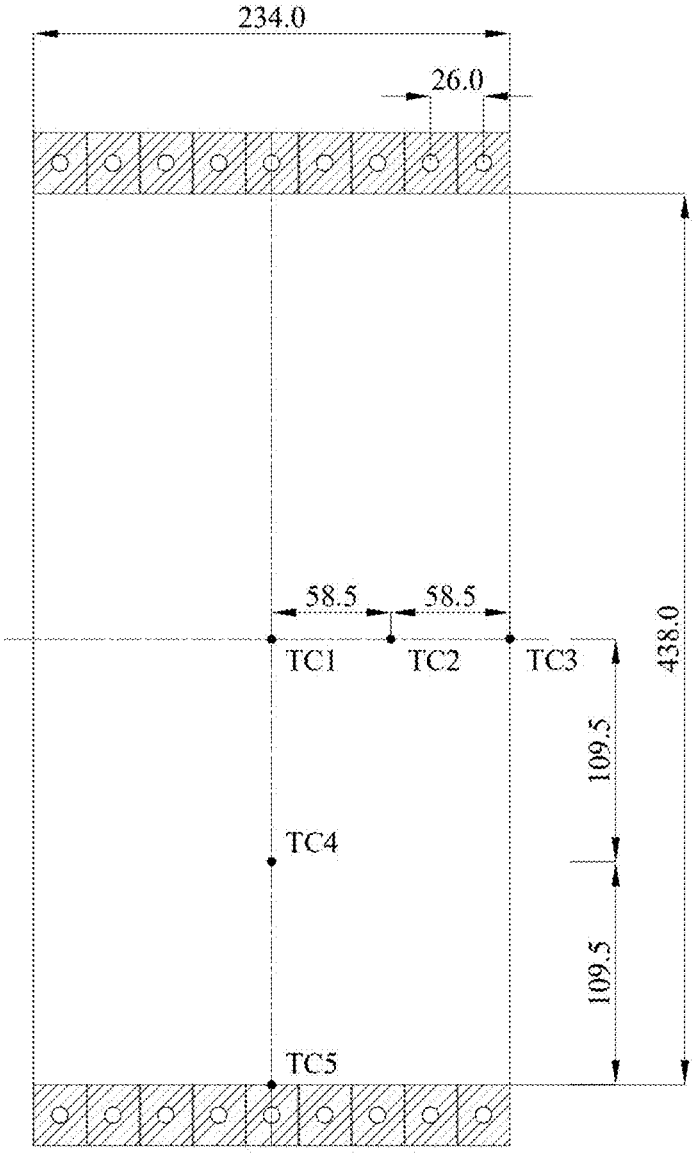
FIG. 3 is a schematic diagram of a specimen specification in an embodiment of the disclosure.

A movable supporting beams 2 set at both ends of the plate shape simulating test platform are force carrying devices. The movable supporting beams 2 are bolted at both ends of the plate shape simulating test platform by rib plates 3. The movable supporting beam 2 is drilled along a lateral direction. As shown in FIG. 3, a schematic diagram of a specimen specification of the disclosure, a size specification of the specimen is provided, wherein according to a conductive clamp 10 (electrode contact point) arranged laterally, a plate/strip specimen is laterally drilled so as a distance between two paths is 26 mm. In the test platform, a thermal field distribution is observed by a thermal imager, and is calibrated by a plurality of thermocouples which are embedded in middle/or edge of the plate/strip in sequence, as shown in positions of TC1, TC2, TC3, TC4 and TC5 in FIG. 3. A first end of the conductive clamp 10 (electrode contact point) is clamped at a laterally punched hole position of a strip specimen. A second end of the conductive clamp 10 (electrode contact point) is connected to a slipknot screw 11 welded at a first end of a tension sensor 12. A second end of the tension sensor 12 is connected to a servo electric cylinder 13. Each servo electric cylinder 13 and tension sensor 12 can be adjusted or measured separately to change the lateral local field distribution of a plate/strip. Its main function is to change a strain field of the plate/strip specimen 9, to realize automatic control of a lateral distribution of the tension, and to simulate a tension lateral distribution condition at an entrance of a rolling mill during a process of an electro-plastic rolling;

The positive current regulating device 4 and the negative current regulating device 8 are respectively arranged at both ends of the large current regulating power supply 5 to realize the respective regulation of the current flowing through the two ends of a specimen. Current supply parameters are synchronously transmitted to an electro-plastic control system, wherein the current supply parameters include high current regulating power source parameters (effective current, frequency, and pulse width) and a conductive sequence. The conductive sequence is current value of a pulse electric current passing through each path. A high-power current control device used by a negative current regulating device 8 has the same structure as a high-power current control device 14 used by a positive current regulating device 4, and it is only necessary to connect its power connection end to the negative electrode of the high current regulating power supply 5.

Figure 4:
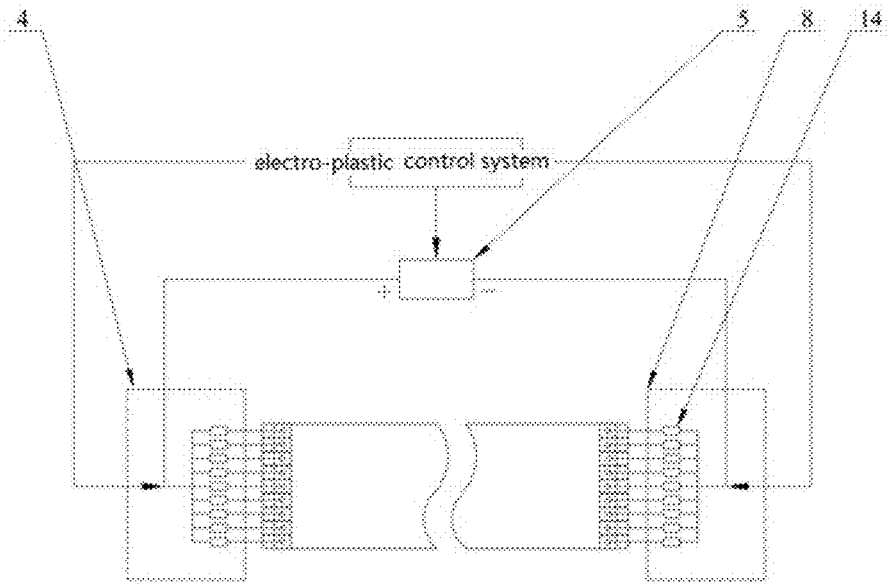
FIG. 4 is a schematic diagram of a high energy electric pulse current distribution control circuit principle in an embodiment of the disclosure.

A real-time change condition of a current field, a thermal field and a strain field on a micro control simulation of high current distribution can be obtained by a signal collecting and processing of the test platform through thermal imager 6, non-contact type full field strain gauge 7 and tension sensor 12. Data of a current field, a thermal field and a strain field obtained in real time by a thermal imager 6, a non-contact type full field strain gauge 7 and a tension sensor 12 is transmitted to an electro-plastic control system. And then, the electro-plastic control system regulates and controls parameters of a high current regulating power supply 5 and resistance value of a high-power current control device 14, such that automatic control of an electric thermal field of a plate/strip is realized;

The principle of a high energy electric pulse current distribution control circuit of an embodiment of the disclosure is shown in FIG. 4. Several conductive clamps (electrode contact points) are distributed laterally along the strip. A negative current regulating device 8 is installed between a negative electrode of a high current regulating power supply 5 and a conductive clamp (electrode contact point). A positive current regulating device 4 is installed between a positive electrode of a high current regulating power supply 5 and a conductive clamp (electrode contact point). A positive current regulating device 4 and a negative current regulating device 8 apply different amplitude currents in different regions by using a high-power current control device 14, thus an internal current field of a plate/strip is changed. A current is collected by a Hall current sensor in real time and fed back to an electro-plastic control system for forming a closed loop. And then, lateral distribution of a tension of a plate/strip is changed by adjusting different thermal fields. Therefore, current field, thermal field and strain field in different regions of a high hardness brittle alloy plate with large width to thickness ratio are actually controlled.

Figure 5:
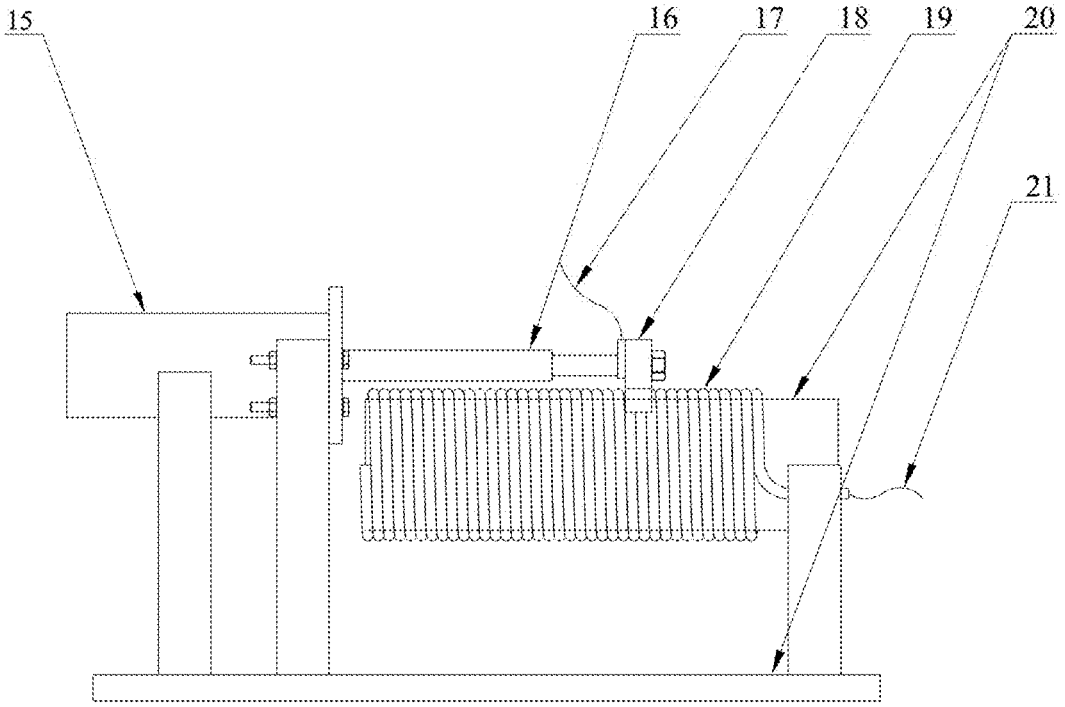
FIG. 5 is a schematic diagram of a high-power current control device in an embodiment of the disclosure.

A high-power current control device 14 used by the positive current regulating device 4 in the embodiment of the disclosure is shown in FIG. 5. The high-power current control device 14 includes a servo motor 15, an insulating push rod 16, a conductive clamp connecting end 17, a high current copper pole slider 18, a copper wire 19, an insulation support 20 and an electric source connecting end 21; the overall conductive metal material is pure copper, and a high-power copper wire 19 is wrapped on the insulation support 20. The surface of the copper wire is insulated. The power supply connecting end 21 is connected to a positive electrode of the high current regulating power supply 5, and the conductive clamp connecting end 17 is connected to a conductive clamp 10; the electro-plastic control system controls the high-current copper pole slider 18 to be driven by the servo motor 15 to change a length of the copper wire connected in an electrical circuit so as to change resistance and gradually change current value in the electrical circuit.

A magnesium alloy strip is preset with a tension of 20 MPa by the plate shape simulation experiment platform, and parameters of a high current regulating power supply are preset with an effective current of 197.7 A, frequency of 500 Hz and pulse width of 45 μs. The method of measuring and controlling the high current of the disclosure is adopted, namely, the high-power current control device is used to apply different amplitude currents in different regions, so as to change internal current field of a plate/strip, and then adjust different thermal field and strain field.

The schematic diagram of the conductive sequence mode of an embodiment of the disclosure is shown in FIG. 6A to FIG. 6D. Several plate defects often appeared in cold rolled strip, such as edge wave, medium wave, composite wave, are simulated by using the plate simulating test platform. In order to improve uniformity of lateral tension distribution, four current distribution control strategies are proposed. As shown in FIG. 6A to FIG. 6D, a current field of a specimen 9 is changed by applying different amplitude currents in different regions, and then a lateral distribution of tension of the plate/strip is changed by adjusting different thermal fields. During the electro-plastic rolling process, the pulse current is applied to the strip, due to the change of the local thermal field and the tensile stress field, the local metal flow in the rolling deformation zone is changed, thereby improving the uniformity of the overall metal deformation and achieving the goal of the plate shape control; For an original plate/strip with certain shape defects, such as edge wave, rib wave, medium wave, oblique stripe, etc., after an original plate shape is collected, an electro-plastic control system automatically outputs electrical parameters of a conduction sequence, a conduction time and a current value etc., according to present tension distribution. A current value, a specimen thermal field and a strain field are obtained by a sensor in real time and fed back to the electro-plastic control system. And finally, tension is controlled evenly by the electro-plastic control system, which controls a high current regulating power supply to output electrical parameters and controls a high current regulating device to adjust a current value of each path.

Figure 6A:
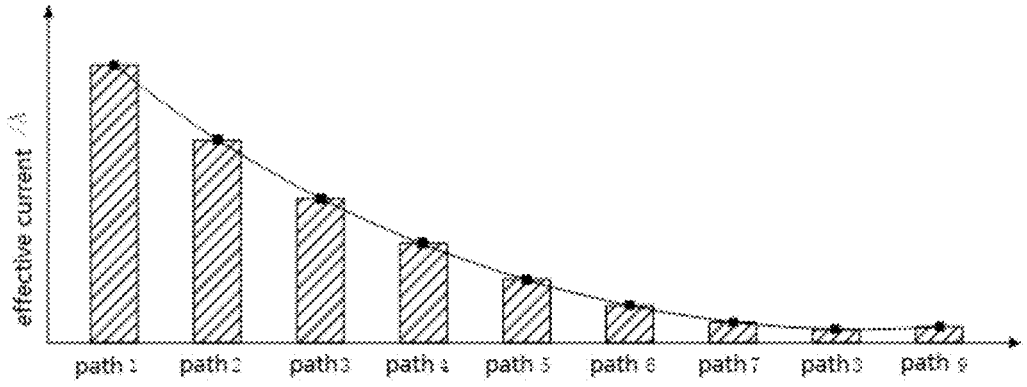
FIG. 6A is a schematic diagram of a first conductive sequence mode in an embodiment of the disclosure.
Figure 6B:
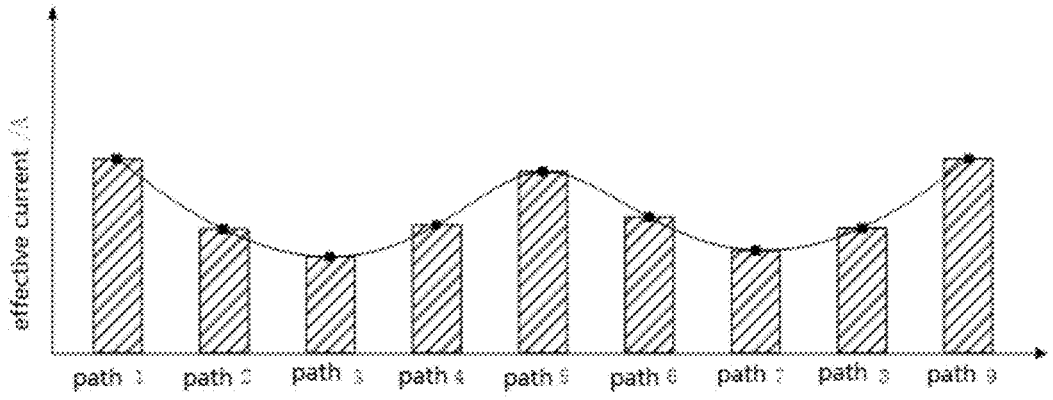
FIG. 6B is a schematic diagram of a second conductive sequence mode in an embodiment of the disclosure.
Figure 6C:
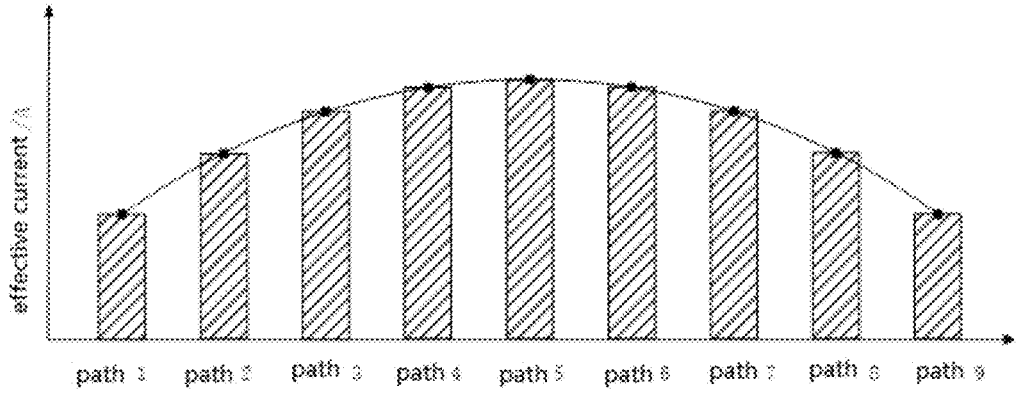
FIG. 6C is a schematic diagram of a third conductive sequence mode in an embodiment of the disclosure.
Figure 6D:
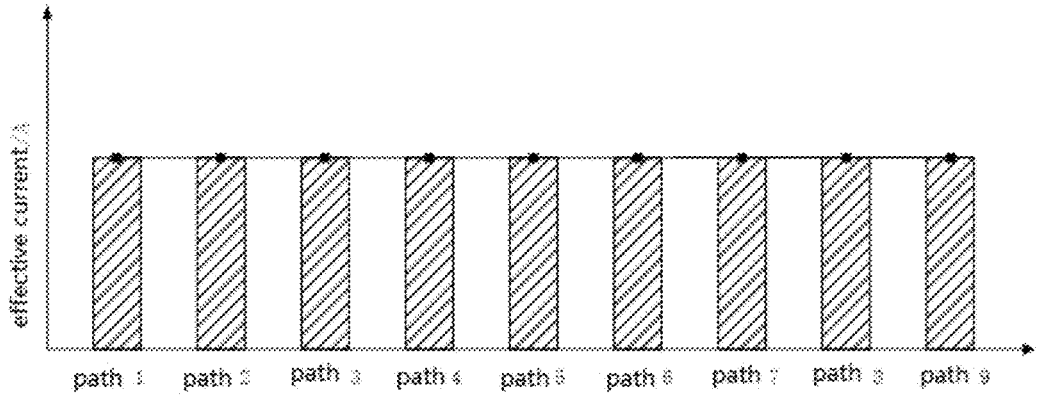
FIG. 6D is a schematic diagram of a fourth conductive sequence mode in an embodiment of the disclosure.

In this embodiment, current loading paths shown in FIG. 6A are obtained by controlling the conduction sequence; The tension difference of the load current path measured by the tension sensor is much larger than other path where no current is applied, and the maximum difference is about 530N. Meanwhile, a thermal field distribution also changes along with a distribution of electric current. The local temperature of the loaded current path is 45° C. higher than that of the non-current path. The non-contact full-field strain gauge shows that the loaded side has a large displacement, while a distal end has basically no displacement; at this time, a current loading mode shown in FIG. 6C is switched on through the electro-plastic control system and the high current regulating power supply. A thermal field of a plate/strip loaded current is measured in real time by a thermal imager and a thermocouple. A high temperature point of a strip is transferred from an edge of the strip to a middle of the strip rapidly. A tension difference measured by a force sensor is also transferred from an edge of the strip to a middle of the strip. This indicates that the thermal field and the strain field distribution of the magnesium alloy strip are changed successfully. An influence of current inflow mode on a current field, a thermal field and a strain field is simulated accurately. It provides reference for establishment of the electro-plastic control system, and provides a new method for controlling an electro-plastic rolling current and a plate shape of a metal plate/strip.

The above-mentioned embodiments only describe the preferred embodiments of the present disclosure, and do not limit the scope of the present disclosure. Without departing from the design spirit of the present disclosure, those of ordinary skill in the art have made various contributions to the technical solutions of the present disclosure. Such modifications and improvements shall fall within the scope of protection determined by the claims of the present disclosure.

What is claimed is:

1. A micro control device for simulating electric thermal field change of a plate/strip, wherein the micro control device comprising a plate shape simulating test platform, a high current regulating power supply, a current regulating device, a thermal imager, a thermocouple, a non-contact type full field strain gauge, a high-power current control device and an electro-plastic control system;

the plate shape simulating test platform comprising a test platform steel plate, a movable supporting beam, a plate/strip specimen, a conductive clamp, a slipknot screw, a tension sensor and a servo electric cylinder;

the test platform steel plate is used to provide support for the movable supporting beam, the plate/strip specimen, the conductive clamp, the slipknot screw, the tension sensor and the servo electric cylinder; the movable supporting beam is fixedly connected to two ends of the test platform steel plate, which is a force bearing device; the movable supporting beam is fixed on the test platform steel plate according to size specification of a specimen, and is drilled along a lateral direction; a longitudinal distance of the movable supporting beam is stepless or multistage adjustable; a first end of the conductive clamp is clamped at a lateral punching position of the plate/strip specimen, a first end of the tension sensor is connected to a second end of the conductive clamp through the slipknot screw, and a second end of the tension sensor is connected to the servo electric cylinder; the servo electric cylinder and the tension sensor can be adjusted or measured separately to change lateral local field distribution of the plate/strip;

the high current regulating power supply provides a current for the plate/strip specimen, and the current is a DC pulse;

the current regulating device comprising a plurality of high-power current control devices which is installed between the high current regulating power supply and the conductive clamp to realize the respective regulation of current flowing through the two ends of the specimen; and the parameters of the current are synchronously transmitted to the electro-plastic control system;

the high-power current control device comprising a servo motor, an insulating push rod, a conductive clamp connecting end, a high current copper pole slider, a copper wire, an insulating bracket and a power supply connecting end; the copper wire is wound on the insulating bracket; the surface of the copper wire is insulated; the power supply connecting end is connected to a positive electrode of the high current regulating power supply, and the conductive clamp connecting end is connected to the conductive clamp; and the servo motor controlled by the electro-plastic control system drives the high current copper pole slider to change length of the copper wire connected to a circuit to change resistance and gradually change a current value in the circuit;

the electro-plastic control system sets off-line and fine-tunes the electrical pulse parameters and the currents of each path according to the initial temperature and tension distribution conditions of the plate/strip, and obtains temperature and tension distribution conditions close to the control target;

the thermal imager is arranged above the test platform for measuring a thermal field of the tested plate/strip, meanwhile the thermal imager is calibrated by a thermocouple embedded on a surface of the plate/strip specimen;

the non-contact type full field strain gauge is arranged above the test platform steel plate with a lens direction of which is perpendicular to an upper surface of the plate/strip specimen, for carrying out a full field strain measurement of the plate/strip specimen;

data of current field, thermal field and stress field obtained in real time by the thermal imager, the non-contact type full field strain gauge and the tension sensor are transmitted to the electro-plastic control system.

2. The micro control device for simulating electric thermal field change of the plate/strip of claim 1, wherein a distance between two paths of the conductive clamp along the plate/strip specimen is 26 mm.

3. The micro control device for simulating electric thermal field change of the plate/strip of claim 1, wherein the thermocouple is embedded in the middle and/or the edge of the plate/strip specimen in sequence.

4. The micro control device for simulating electric thermal field change of the plate/strip of claim 1, wherein further comprising a Hall current sensor; the Hall current sensor is installed on a wire connecting the high-power current control device and the conductive clamp, for collecting in real time and feeding each path current back to the electro-plastic control system to form a closed loop so as to obtain a target current field, a target thermal field and a target stress field.

5. The micro control device for simulating electric thermal field change of the plate/strip of claim 1, wherein the current regulating device comprising a positive current regulating device and a negative current regulating device; the positive current regulating device is connected between a positive electrode of the high current regulating power supply and the conductive clamp; the negative current regulating device is connected between a negative electrode of the high current regulating power supply and the conductive clamp.

6. The micro control device for simulating electric thermal field change of the plate/strip of claim 1, wherein the movable supporting beam is bolted at two ends of the test platform steel plate through a rib plate.

7. The micro control device for simulating electric thermal field change of the plate/strip of claim 1, wherein a current provided by the high current regulating power supply is DC pulse, and peak current, pulse width and frequency of the DC pulse can be adjusted online.

8. The micro control device for simulating electric thermal field change of the plate/strip of claim 1, wherein the synchronous current parameters transmitted to the electro-plastic control system comprising the high current regulating power supply parameters and a conductive sequence; the conductive sequence is a current value of the pulse current passing through each path, and the high current regulating power supply parameters include effective current, frequency and pulse width.

* * * * *